United States Patent [19]

Peace et al.

[11] Patent Number: 4,958,629

[45] Date of Patent: Sep. 25, 1990

[54] WATER-POWERED ORAL HYGIENE DEVICE

[75] Inventors: Steven L. Peace; John E. Petrovic, both of Fort Collins, Colo.

[73] Assignee: Teledyne Industries, Inc., d/b/a Teledyne Water Pik, Fort Collins, Colo.

[21] Appl. No.: 209,302

[22] Filed: Jun. 21, 1988

[51] Int. Cl.[5] ..... A61H 9/00

[52] U.S. Cl. ..... 128/66

[58] Field of Search ..... 433/80; 128/66, 62 A

[56] References Cited

U.S. PATENT DOCUMENTS 3,820,532 6/1974 Eberhardt ..... 128/62 A

*Primary Examiner*—Cary E. Stone

*Attorney, Agent, or Firm*—Hugh H. Drake

[57] ABSTRACT

The housing of an oral hygiene device is attachable to a water faucet. A regulator within the housing responds to the water which is subject to pressure variation. The regulator accommodates that variation in developing automatically a stream of water at a constant pressure. A turbine within the housing is caused to rotate in response to energy in the stream. A piston pump draws water deflected by impellers on the turbine and forms that water into a series of pulses. A flexible hose coupled to the housing includes a handle for directing the pulses against the teeth and gums of a user at a desired pressure.

12 Claims, 2 Drawing Sheets

WATER-POWERED ORAL HYGIENE DEVICE

SPECIFICATION

The present invention relates to oral hygiene appliances. More particularly, it pertains to a water-powered oral hygiene device capable of forming water delivered from a faucet into a series of pulses and deriving its operating power entirely from energy in the delivered water.

Over a period of about the last twenty-five years, oral hygiene appliances operated by an electric motor have enjoyed substantial and widespread commercial success. Beginning with a device constructed in accordance with the principles taught in U.S. Pat. No. 3,227,158, applicant's assignee and its predecessor developed and introduced into the marketplace various devices featuring a succession of improvements and additional or alternate features, many of which have been disclosed and claimed in a series of later patents. At the same time, a number of patents have issued to others with regard to motor-driven oral hygiene appliances, and some of those appliances have, from time to time, also been introduced into the marketplace.

Over a period of many more years, various other devices for a variety of different purposes have been devised to include a means for delivering water in a series of pulses and applying those pulses to a point of use. In particular, a number of devices have been suggested for attachment to a water faucet in order to use the energy in the water from that source for the purpose of delivering a pulsating water jet intended for use in dental hygiene. A simple such approach was to drive a turbine and cause that turbine to alternately open and close a port through which the water is caused to pass and by which action the water is chopped into a series of pulses. Other approaches have sought to employ fluidic oscillators or mechanical elements caused to oscillate in order to open and close ports and thereby achieve pulsation.

One representative prior approach is that disclosed in U.S. Pat. No. 3,820,532. Therein, a turbine drives a rotary interruptor, and speed is controlled by varying the angle of one or more nozzles. Pulse intensity is varied by manually adjusting a metering valve. Included in that disclosure, as well as in others, is the concept of being able to introduce an additive, in that case by causing the water in its flow to pass through an installed cartridge.

A related prior approach of background interest is to be found in U.S. Pat. No. 3,545,435. Water from a faucet causes rotation of a turbine which in turn drives a pump piston in order to produce a series of water pulses that ultimately are delivered to a jet tube. A pressure "regulator" is included in an output conduit in order to prevent the pressure of the water delivered from exceeding a desired pressure. The disclosure of this patent also mentions the adding of a mouthwash solution. In addition, there is an arrangement for using the pulsating water either as a jet which is directed against the teeth and gums of the user or for the purpose of powering the movement of the head of an attached toothbrush. The latter alternative has also been a feature of several other patents wherein the pulses are produced by one of the aforementioned motor-driven oral hygiene appliances.

In other fields, systems have been known which include a device that increases delivered fluid-flow pressure over that available from a source. An ordinary water pump does that, of course. Pressure boosters have found use for various purposes, such as the so-called "air motors" which accept typical "shop air", at eighty to one-hundred pounds per square inch (psi), and develop mechanical driving pressures of much greater magnitude.

Nevertheless, currently available water-powered oral irrigators exhibit limitations in their performance characteristics. Whether mounted on a faucet or attached to a shower pipe, some have advantageously utilized incoming water flow for supplying the power which effects pulsation. In general, however, these devices have failed to attain the performance characteristics which have been developed into motor-driven oral hygiene appliances in terms of the delivered water flow rate, impact pressure and frequency of the water pulses. A major disadvantage encountered with at least most of these known irrigators is that the output performance changes with variation in input water flow characteristics.

Many municipal water systems are designed with the primary goal of insuring the supply to fire hydrants of sufficient available flow at a pressure suitable for the purpose of fire fighting. This typically means a desired pressure at the hydrant in the range of seventy or eighty psi. It is common experience, however, that municipal water pressures from time to time fall to a substantially lower pressure, especially during times of high water usage as in the summer when lawns are being watered. In addition, rural users having their own well or spring as a supply often employ a pumping system which feeds to a pressure tank, and in which tank the pressure delivered by the store of water controllably cycles with use between what may be only twenty psi and forty psi.

Even though the typical lavatory faucet has a "regulator" valve for adjusting its outlet flow, such a valve cannot overcome incoming supply pressure variations that lead to too low a pressure, whatever the reason may be for the occurrence of those. Especially at times of low pressure, use of water at one connection often varies pressure at another connection where it may be desired to use an oral irrigator.

It is, accordingly, a general object of the present invention to provide a new and improved oral hygiene device which overcomes the disadvantages and performance limitations of such prior devices.

Another object of the present invention is to provide a new and improved water-powered oral hygiene device which delivers a series of water pulses within a desired pressure range, regardless of variation of input water flow or pressure over a wide range of values.

A further object of the present invention is to achieve the foregoing aims in a compact unit fully capable of being economically manufactured in mass production.

Still another object of the present invention is to provide a water-powered oral hygiene device in accordance with the foregoing which is readily adaptable to include further features, known as such, for introducing an additive, easily controlling pulse output pressure and/or facile attachment to an existing water faucet.

In accordance with one embodiment of the present invention, an oral hygiene device includes a housing with an inlet for receiving water from a source at a pressure which is subject to variation. Within that housing is a regulator coupled to the inlet and responsive to the water therefrom to accommodate that variation and develop automatically a stream of water at a constant pressure. Also disposed within the housing are means responsive to energy in the stream for forming the stream into a series of pulses. Finally, means coupled to the housing delivers those pulses to a point of use with a desired impact force.

The features of the present invention which are believed to be patentable are set forth with particularity in the appended claims. The organization and manner of operation of one specific embodiment of the invention, together with further objects and advantages thereof, may best be understood by reference to the following description taken in connection with the accompanying drawings in the several figures of which like reference numerals identify like elements, and in which:

Figure 1:
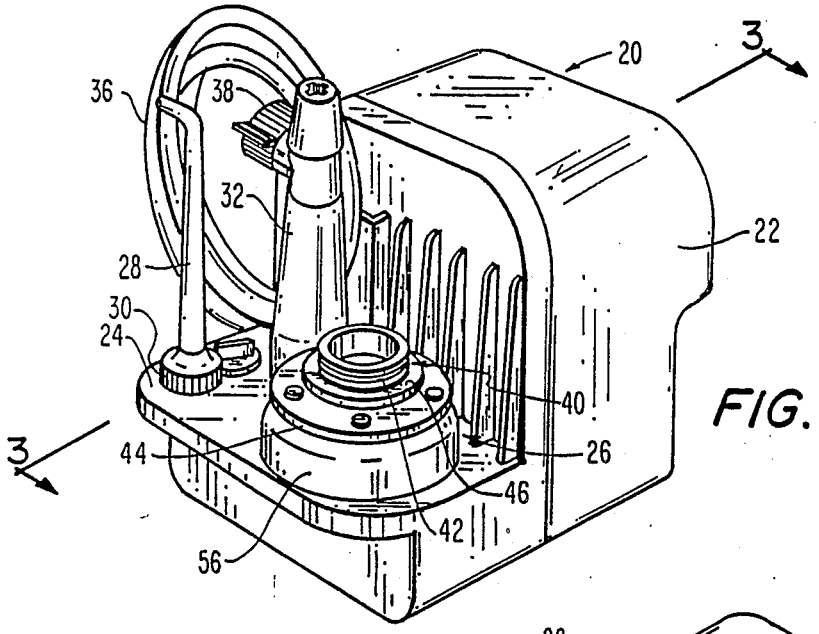
FIG. 1 is an isometric view of a specific embodiment of an oral hygiene device.
Figure 2:
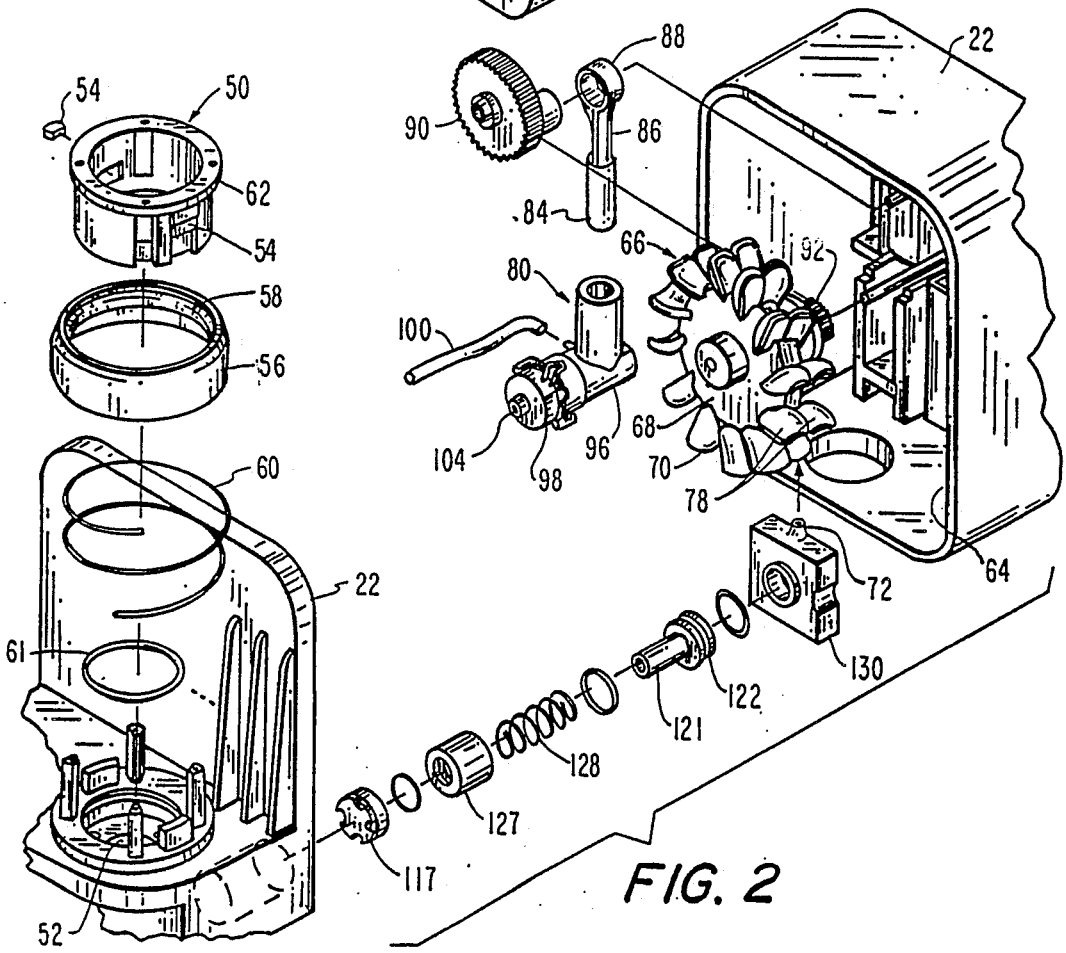
FIG. 2 is an exploded isometric view of the device shown in FIG. 1.
Figure 3:
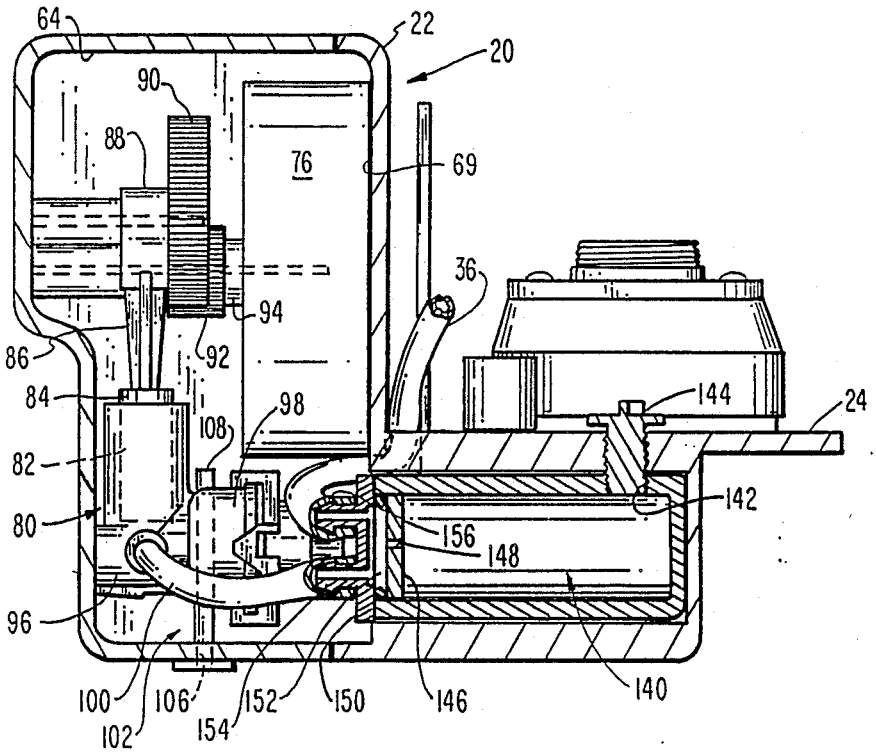
FIG. 3 is a cross-sectional view taken along the line 3—3 in FIG. 1.
Figure 4:
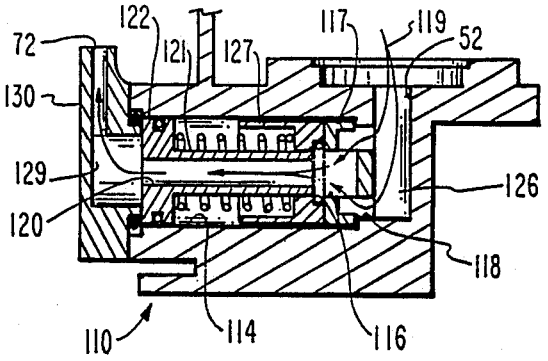
FIG. 4 is a longitudinally-taken fragmentary cross-sectional view of a component shown as exploded in FIG. 2.

An oral hygiene device 20 includes a housing 22 externally shaped to define a platform 24 alongside and from which upwardly projects a faucet attachment 26. A recess formed into platform 24 conveniently seats for storage a jet tip 28 on which is mounted a ferrule 30 for grasping by the user. Tip 28 is a hollow tube formed at its outer end to define a nozzle having an outlet orifice.

Also mounted on platform 24 is a handle 32 into an outer end of which jet tip 28 is inserted in order to receive flow which passes through a channel internally defined within handle 32. The lower end of handle 32 includes a recess insertable over a pedestal formed on platform 24 in order to accept that recess for storage of the handle.

A flexible tube or conduit 36 leads from the channel within the interior of handle 32 and continues on into the interior of housing 22. Projecting laterally to one side of handle 36 is a knob 38 connected internally to a valve disposed in the path of flow within the conduit inside handle 32. By means of the thumb and/or forefinger of the user, knob 38 may be rotated in order adjustably to open and close that valve and thereby achieve control of the impact force of pulses of water delivered by way of tube 36 through handle 32 and jet tip 28. The details of construction of that internal valve within handle 32 are disclosed in co-pending U.S. patent application Ser. No. 875,203, filed June 17, 1986, and assigned to the same assignee as the present application. Accordingly, that application is incorporated herein by reference.

Conventionally included, usually, on the end of the spout of the user's water faucet is a threadably mounted aerator. Included within the present combination is an aerator 40 intended to be substituted for an existing aerator. Aerator 40, therefore, is threaded at 42 to mate with the standard threads usually formed on the faucet end. As shown, it is designed to mate with internal threads on the faucet, although an alternative aerator may be supplied with internal threads to mate with a faucet which presents external threads as sometimes is the case. Still further, it is known to supply, as another alternative, an adaptor sleeve that enables attachment to a faucet which had not previously been threaded to accept an aerator unit. In any case, a flange 44 encircles the central portion of the body of aerator 40 and presents a ledge 46 which faces upwardly when installed.

Aerator 40 conveniently may be formed to have a mesh outlet screen and an internally included one-piece air entraining unit of the kind described in more detail in U.S. Pat. No. 4,686,037 issued Aug. 11, 1987, assigned to the same assignee as the present application. Correspondingly, that patent is incorporated herein by reference.

Connector 26 includes a hollow boss 50 which projects upwardly from platform 24 and in the bottom of which housing is an opening 52 that leads into the interior of housing 22. The free ends of a space-opposed pair of lugs 54 slidingly project through the wall of boss 50. Lugs 54 may be resiliently supported in order to have them function as a snap-fastener. A ring 56 encircles and is slideable a limited distance along the outside of boss 50, with the interior of ring 56 shaped to define a cam 58 disposed to urge lugs 54 into latched engagement upon ledge 46 when ring 56 is urged upwardly by captivated compression spring 60. A collar 62 prevents the escape of ring 56, and an O-ring 61 completes a seal. As depicted, boss 50 is positioned and secured by the interfitting of a plurality of posts which are received within corresponding recesses. To mount device 20 to the faucet on which aerator 40 has been mounted, the user need only move boss 50 over aerator 40 until lugs 54 engage and lock over flange 44. To remove the unit from the faucet, the user simply grasps ring 56 between his fingers and urges it downwardly on boss 50 in order to enable lugs 54 to free themselves from ledge 46.

Defined within housing 22 is a cavity 64 which, as will be seen, also serves as a reservoir. Disposed within cavity 64 is a turbine 66 which includes a rotor 68 mounted for rotation on a shaft that fixedly projects from one wall 69 of cavity 64. A plurality of impellers 70 are successively spaced peripherally around rotor 68 and in the path of a stream of water produced by a nozzle 72. A shroud 76 partially surrounds rotor 68, beginning at a location beyond the point of impingement of that stream from nozzle 72 against impellers 70. Preferably, each impeller 70 is formed of a pair of cups 78 individually mutually spaced laterally of rotor 68. Nozzle 72 directs its outletted stream centrally of those cups, so that the force of the impelling stream is fully distributed over each pair of cups. This serves to balance any lateral forces which otherwise would tend to urge rotor 68 in one direction or the other, thus causing rotor 68 to assume a centered position during operation.

Also mounted within cavity 64 is a pump 80 which has a pump body within which is formed a cylinder 82. A piston 84 is slidingly received for reciprocation within cylinder 82. Piston 84 is connected to one end of a connecting rod 86 the other end of which is connected to a bearing 88 eccentrically located on a driven gear 90. Gear 90 meshes with a driving gear 92 secured upon shaft 94 of rotor 68. Thus, rotation of rotor 68 in response to a stream of water delivered from nozzle 72 causes reciprocation of piston 84 within cylinder 82.

Formed over one end of cylinder 82 is a cylinder head 96. Cylinder head 96 enables water within cylinder 82 to exit from the cylinder upon movement of piston 84 toward head 96, with that water being delivered into a conduit 100 and in the form of a series of pulses. Included within a manifold 98 which opens into head 96 is an inlet check valve. If desired, an outlet check valve may be included at the entrance to conduit 100, although this has not been found to be necessary in view of the flow path dimensions.

While the structural particulars of pump 80 may be varied, suitable and preferred pump structures as incorporated herewith are described and illustrated in more detail in U.S. Pat. Nos. 4,302,186 and 4,108,167 assigned to the same assignee as the present application. Accordingly, those patents are incorporated herein by reference.

As mentioned above, cavity 64 defines a reservoir, and it will be observed that both turbine 66 and pump 80 are located within that reservoir. Water deflected by impellers 70 is collected into the bottom of cavity 64 to form a sump 102. The inlet 104 into manifold 98 of pump 80 is disposed within that sump region so that action of pump 80 serves to draw the pump water supply from sump 102. An opening 106 defined in the bottom of cavity 64 serves to drain excess water collected in sump 102 on into the underlying lavatory, sink, tub or other receptor. An upwardly projecting tube 108 serves as a standpipe to maintain a preselected level of the collected water within sump 102 at all times. By appropriate sizing of drain opening 106 in correspondence with the controlled flow through nozzle 72, about to be explained, standpipe 108 may be eliminated.

Defined within the base of housing 22 beneath platform 24 is a pressure regulator 110. Regulator 110 includes an enclosure within which is defined a first bore 114 having a larger diameter and a second bore 116 having a lesser diameter. In this case, smaller bore 116 is specifically defined in a plug 117 seated in the entrance end of bore 114. Plug 117 includes internal passages 118 that permit inletted water to flow along paths indicated by arrows 119 and on into the interior 120 of a hollow piston 121. Piston 121 is formed at its downflow end portion to define an enlarged piston end 122.

The opposing end portions of piston 121 are slidingly sealed within their respective bores by means of the illustrated O-rings. An entrance 126 adjacent to plug 117 receives water through opening 52 in the bottom of boss 50 from the faucet to which the unit is attached. A guiding sleeve 127 mounted on bore 114 serves to mount a seal, as shown, and captivate a spring 128 compressed between the sleeve and piston end 122.

The sealing of the respective bores by the use of O-rings as shown has been alternatively accomplished by molding the piston to have integral skirts which resiliently serve that sealing function. This approach is the same as that used for sealing the piston in the pump cylinder of the aforesaid U.S. Pat. No. 4,108,167.

Water received within entrance 126 flows through the hollow interior of piston 121, delivering energy stored in a chamber 129 which leads into nozzle 72 that serves as a restricted orifice. Chamber 129 and nozzle 72 both are defined within a cap 130 that closes the downflow end of bore 114. When the energy in the flow delivered into entrance 126 is at the low end of the accommodative range, say twenty psi, the assignment of values to the operating parameters of turbine 66 and pump 80 is such that all porting is open within regulator 110.

When, however, that energy in the incoming flow exceeds a predetermined level within chamber 129, the back pressure developed within chamber 129 drives piston 121 toward entrance 126. That gradually closes the porting in plug 117. The flows and the pressure resulting are a direct result of the balance of forces acting on the elements of regulator 110. The resulting pressure at the outlet of piston 121 then approaches the pressure which results when the incoming energy is lower.

In this specific embodiment, turbine 66 is structured, in combination with nozzle 72, pump 80 and all hoses, conduits and other water-flow passages, to cause the delivery from the outlet of jet tip 28 at seventy-five psi with knob 38 in its fully-open position. To that end, the usually necessary pressure drop is controlled in part by the degree in which passages 118 are opened by piston 121 under the governance of spring 128. In addition to the spring action, the pressure area and, to a lesser extent, the frictional forces also determine the degree to which those passages are opened.

Also defined within the base portion of housing 22 beneath platform 24 is a chamber 140 into which a port 142 opens through platform 24 and is closable by a plug 144 threaded into port 142. On removing plug 144, the user is able to insert a liquid additive such as a dentifrice, plaque-removal agent and/or mouthwash. A transverse wall 146 disposed across one end of chamber 140 includes a central orifice 148. A cover 150 is spaced from wall 146 to define a passage 152. A fitting 154 couples conduit 100 into passage 152, so as to feed water pulses into that passage. Hose 36, which leads from handle 32, connects interiorly of housing 22 to another fitting 156 that leads from passage 152.

During the pressure stroke of piston 84, the pulses delivered by way of tube 100 enter passage 152 and, through orifice 148, pressurize chamber 140. When piston 84, however, is on its return stroke, the pressure within cylinder head 96 is reduced, allowing the liquid additive within chamber 140 to flow out of orifice 148 and into the lower pressure region within passage 152. During the subsequent pressure stroke, that small amount of additive just delivered into passage 152 mixes with the pulses of water which are conveyed on to handle 32 through hose 36.

The overall approach is that of transforming a flow of water to a point of impact from a source the pressure of delivery of which is subject to variation. The flow of water from that source is received and transformed into a series of pulses. Those pulses are delivered to the point of impact with a preselected force. During all of that, there is automatic response to variation in the pressure of delivery by effecting delivery of the pulses to the point of impact at a selected pressure as translated into force.

In an operating prototype, all essential parts except fasteners were molded or otherwise formed of plastic. The different components allowed individual fabrication by the use of automatic molding techniques and equipment. Even the final assembly of the entire unit was readily accomplished through an assembly line approach. The assembly was quick and certain.

The result of all of the foregoing is a simple and yet durable as well as economical unit. Yet, the resultant oral hygiene device fully achieves the objective of being powered entirely by the water from a faucet, through connection to the supply within a shower stall or the like. At the same time, full desired impact pressure, and other desired performance characteristics available with present-day electric motor driven oral hygiene appliances, are obtained. In that connection, the performance characteristics specified in the aforesaid U.S. Pat. No. 3,227,158 become available and certain.

While a particular embodiment of the invention has been shown and described, and various changes and alternatives have been suggested, it will be obvious to those skilled in the art the changes and modifications may be made without departing from the invention in its broader aspects. Therefore, the aim in the appended claims is to cover all such changes and modifications as fall within the true spirit and scope of that which is patentable.

We claim:

1. An oral hygiene device comprising:
a housing;
an inlet in said housing for receiving water from a source at a pressure subject to variation;
a regulator, within said housing, coupled to said inlet and responsive to said water from said inlet to accommodate said variation and develop automatically a stream of said water at a constant pressure;
a turbine having a rotor mounted within said housing for rotation;
a plurality of impellers successively spaced peripherally around said rotor;
a nozzle mounted in said housing and coupled to said regulator for directing said stream against said impellers to rotate said rotor;
a pump disposed within said housing and having a piston mounted for reciprocation within a cylinder;
means responsive to rotation of said rotor for driving said piston in reciprocation;
a head disposed over one end of said cylinder;
means responsive to water from said stream deflected by said impellers for enabling movement of said piston away from said head to draw water into said cylinder;
means for enabling said water in said cylinder to exit from said cylinder, upon movement of said piston toward said head, as a series of pulses;
and means coupled to said head for delivering said pulses from said housing.

2. A device as defined in claim 1 in which said delivering means further includes:
a flexible conduit receptive of water received from said exit for conveying said water to a point of use;
and means for controlling the volume of flow through said conduit to vary the degree of impact of said pulses upon said point of use.

3. A device as defined in claim 2 in which said conduit includes a handle for directing said pulses selectively toward a chosen point of use, and in which said controlling means is located in said handle.

4. A device as defined in claim 1 in which said regulator includes;
an enclosure;
a bore defined within said enclosure and having a predetermined diameter;
a hollow piston having a first end portion slideable within said first bore and a second end portion;
means defined in said enclosure for directing said water from said inlet into the interior of said hollow piston through said second portion;
means defined in said enclosure for producing said stream in response to water conveyed through the interior of said piston;
means for resiliently urging said piston in a given direction with respect to said directing means;
and means for throttling the volume of water flow through the interior of said piston in response to movement of said piston between said directing means and said producing means.

5. A device as defined in claim 1 which further includes:
means defining a chamber;
a port for introducing an additive into said chamber;
means defining a passage adjacent to said chamber;
means defining an orifice between said chamber and said passage;
means for coupling said enabling means to said passage to receive said pulses therein;
and means for delivering said pulses from said passage.

6. A device as defined in claim 1 in which said impellers are each composed a pair of cups mutually spaced laterally of said rotor.

7. A device as defined in claim 1 which includes means within said housing defining a reservoir, in which said turbine is disposed within said reservoir and said deflected water is collected to form a sump in the bottom of said reservoir and in which said pump is disposed within said reservoir in a position to draw said water from said sump.

8. An oral hygiene device comprising:
a housing;
an inlet in said housing for receiving water from a source at a pressure subject to variation;
a regulator, within said housing, coupled to said inlet and responsive to said water from said inlet to accommodate said variation and develop automatically a stream of said water at a substantially constant pressure;
means, disposed within said housing, responsive to said energy in said stream for forming said stream into a series of pulses at a selected pressure level;
and means coupled to said housing for delivering said pulses to a point of use with a desired inpact force.

9. A device as defined in claim 8 in which said forming means includes:
a turbine having a rotor mounted within said housing for rotation;
a plurality of impellers successively spaced peripherally around said turbine:
a nozzle mounted in said housing for directing said stream against said impellers to rotate said rotor;
and means driven by said rotor for developing water deflected by said impellers into said series of pulses.

10. An oral hygiene device comprising: a housing;
an inlet in said housing for receiving water from a source at a pressure subject to variation;
a regulator, within said housing, coupled to said inlet and responsive to said water from said inlet to accommodate said variation and develop automatically a stream of said water at a substantially constant pressure;
means, disposed within said housing, responsive to said energy in said stream for forming said stream into a series of pulses at a selected pressure level;
means coupled to said housing for delivering said pulses to a point of use with a desired impact force;
said forming means further including:
a pump disposed within said housing and having a piston mounted for reciprocation within a cylinder;
means responsive to the flow of said stream for driving said piston in reciprocation;
a head disposed over one end of said cylinder;
means responsive to water from said stream deflected by said impellers for enabling movement of said piston away from said head to draw water into said cylinder;

and means for enabling said water in said cylinder to exit from said cylinder, upon movement of said piston toward said head, as said series of pulses.

11. An oral hygiene device comprising:

a housing;

an inlet in said housing for receiving water from a source at a pressure subject to variation;

a regulator, within said housing, coupled to said inlet and responsive to said water from said inlet to accommodate said variation and develop automatically a stream of said water at a substantially constant pressure;

means, disposed within said housing, responsive to said energy in said stream for forming said stream into a series of pulses at a selected pressure level;

means coupled to said housing for delivering said pulses to a point of use with a desired impact force; said variation being subject to result in a pressure substantially less than a desired level, said responsive means being structured to accommodate said pressure when at a revised level substantially less than said desired level, and said regulator adjusting said pressure downwardly to said revised level when said pressure is above said revised level.

12. The method of transforming a flow of water to a point of impact from a source the pressure of delivery from which is subject to variation and which comprises:

receiving said flow of water from said source;

transforming said flow of water received from said source into a series of pulses thereof;

delivering said pulses to said point of impact with a preselected force;

and automatically responding to variation in said pressure of delivery by effecting delivery of said pulses to said point of impact with said preselected force.

* * * * *